US011404225B2

(12) United States Patent
Arrighetti et al.

(10) Patent No.: US 11,404,225 B2
(45) Date of Patent: Aug. 2, 2022

(54) LOW-VOLTAGE CIRCUIT BREAKER

(71) Applicant: ABB S.p.A., Milan (IT)

(72) Inventors: Pierantonio Arrighetti, Bossico (IT); Michele Ferrari, Bergamo (IT)

(73) Assignee: ABB S.p.A., Milan (IT)

( * ) Notice: Subject to any disclaimer, the term of this patent is extended or adjusted under 35 U.S.C. 154(b) by 381 days.

(21) Appl. No.: 16/385,416

(22) Filed: Apr. 16, 2019

(65) Prior Publication Data

US 2019/0326072 A1 Oct. 24, 2019

(30) Foreign Application Priority Data

Apr. 19, 2018 (EP) ..... 18168308

(51) Int. Cl.
*H01H 73/18* (2006.01)
*H01H 9/36* (2006.01)
*H01H 9/34* (2006.01)

(52) U.S. Cl.
CPC ..... *H01H 9/362* (2013.01); *H01H 9/346* (2013.01); *H01H 73/18* (2013.01)

(58) Field of Classification Search
CPC ..... H01H 9/34–2009/367; H01H 73/18
See application file for complete search history.

(56) References Cited

U.S. PATENT DOCUMENTS 3,641,293 A * 2/1972 Armitage ..... H01H 9/36 218/151
3,641,294 A * 2/1972 Armitage ..... H01H 9/36 218/149
5,841,088 A * 11/1998 Yamaguchi ..... H01H 9/302 218/158
2002/0012214 A1 1/2002 Benard et al.
2008/0074216 A1 3/2008 Annis et al.
2015/0136740 A1* 5/2015 Afshari ..... H01H 33/08 218/149

FOREIGN PATENT DOCUMENTS

DE 202015101839 U1 4/2015

OTHER PUBLICATIONS

European Patent Office, Extended Search Report issued in corresponding Application No. 18168308.7, dated Oct. 2, 2018, 6 pp.

* cited by examiner

*Primary Examiner* — Ramon M Barrera
(74) *Attorney, Agent, or Firm* — Armstrong Teasdale LLP

(57) ABSTRACT

A low-voltage circuit breaker comprising one or more electrical poles, each of said poles having an internal space with a contact area and an arc extinguishing area, a fixed contact assembly and a movable contact assembly being positioned in said contact area, said movable contact assembly being movable between a closed position in which it is into contact with said fixed contact assembly and an open position in which it is spaced apart from said fixed contact assembly, an arc chamber comprising a plurality of substantially parallel arc-breaking plates made of a ferromagnetic material being positioned in said arc extinguishing area. The low-voltage circuit breaker is characterized in that said arc chamber further comprises at least one arc-breaking plate which is at least partially made of a ceramic material.

17 Claims, 8 Drawing Sheets

LOW-VOLTAGE CIRCUIT BREAKER

The present invention relates to a low voltage circuit breaker, for example for industrial environments.

It is known that low voltage circuit breakers usually comprise a case containing one or more poles, associated with each of which are at least one pair of contacts reciprocally engageable with and disengageable from one another. Prior art circuit breakers also comprise control means which cause the relative movement of said pairs of contacts so that they can assume at least a first engaged position (circuit closed) and a second separated position (circuit open).

Generally the pairs of reciprocally engageable/disengageable contacts are composed of first elements, substantially fixed (fixed contacts) and second movable elements (movable contacts). The control means instead comprise actuating mechanisms which terminate, for example, in a main shaft operatively connected to said movable contacts.

Moreover, at least one arc chamber is generally associated with each pole of the circuit breaker, i.e. a region of space made particularly suitable to facilitate interruption of the electrical arc. Arc chambers can be simple regions produced in the circuit breaker case, or can comprise various modular elements, for example structured as cases made of insulating material provided with arc splitter plates.

As it is known, during the useful life of a circuit breaker, phenomena which expose the circuit breaker and the network to particularly heavy stresses can occur. This happens in the first place when the circuit breaker is required to withstand, even for short periods, currents greater than the rated values. The time during which the circuit breaker and the electrical network are exposed to an overcurrent (i.e. an overload or short circuit) generally depends on the time required by protection devices to effectively make the circuit breaker safe, i.e. to interrupt the overcurrent. As it is known, in order to limit the occurrence of damages both to the electrical network and to the actual circuit breaker or parts thereof (contact plates, extinguishing chamber, control, insulating elements), many methods have been tried and established to make opening as rapid and effective as possible. Different solutions include, for example, the use of appropriate control springs and materials suitable to withstand high stresses and temperatures.

Other solutions provide for the use of gasifier means and/or materials, capable of releasing extinguishing substances in proximity of the area in which the electric arc is formed; these means and/or materials are typically triggered by the temperature reached when an electric arc occurs. In general, in low voltage power circuit breaker, the critical function of interrupting the current (whether nominal, overload or short-circuit current) is provided by the circuit breaker in a specific portion of said circuit breaker which is constituted by the so-called deionizing arc chamber.

Thus, generally associated to each pole of a low voltage switch there is at least one arc chamber, i.e., a region of space particularly designed to foster electric-arc interruption. Arc chambers can be simple regions provided in the casing of the switch, or else can comprise various modular elements shaped, for example, like casings made of insulating material equipped with arc-breaking plates. Modular arc chambers, which are more advanced, present the advantage of being easily replaceable and of being doable with materials that are more suitable as compared, for example, to the ones used for the casing of the switch.

As a consequence of the opening movement, the voltage between the contacts causes the dielectric discharge of the air, leading to the formation of the electric arc in the chamber. The arc is propelled by electromagnetic and fluid-dynamics effects inside a series of arc-breaking metal plates arranged in the chamber, which are meant to extinguish said arc by cooling and splitting actions.

During arc forming, the energy released by Joule effect is very high and causes thermal and mechanical stresses inside the plate containment region. In order to withstand these stresses, the design of the arc chamber must be evaluated carefully so as to obtain a component which is solid enough to withstand the thermal and mechanical stresses. It is worth noting that the arc energy in critical short circuit tests can be as high as 100 kJ, and even more.

In low voltage power circuit breaker, the major arc cooling processes take place by magnetic blowing (Lorentz force) and ablation of the solid surfaces. The very high temperatures that develop during arching phenomena can lead to melting and damages of the arc-breaking metal plates arranged in the chamber, both during a single short circuit and during an O—CO—CO cycle. Indeed, it normally happens that, after such events, the operation of the circuit breaker is impaired and a number of arc-breaking metal plates have to be replaced, if not the whole arc chamber assembly.

Moreover, the design of the chamber must guarantee appropriate guidance of the arc into the extinguishing region while providing protection of the regions that must not be affected. Indeed, if insulation is not optimal, it is possible in some instances that the arc "escapes" (current leakage) from the arc chamber with very dangerous arc formation between the movable contacts and other metallic parts outside the interruption region, such as the driving mechanisms or other accessories of the low voltage switch.

On the basis of the above considerations, there is a need to have available alternative technical solutions that will enable the limits and the problems set forth above to be overcome. Hence, the present disclosure is aimed at providing a low-voltage power circuit breaker provided with an arc chamber, which allows overcoming at least some of the above-mentioned shortcomings.

In particular, the present invention is aimed at providing a low-voltage power circuit breaker provided with an arc chamber which is able to withstand the electrical and magnetic effects following the formation of an electrical arc in the arc chambers.

Furthermore, the present invention is aimed at providing a low-voltage power circuit breaker provided with an arc chamber which is able to guarantee the required insulation in case of formation of an electrical arc in the arc chambers.

Moreover, the present invention is aimed at providing a low-voltage power circuit breaker provided with an arc chamber, in which the ablation of the solid surfaces in case of formation of an electrical arc in the arc chambers is reduced.

In addition, the present invention is aimed at providing a low-voltage power circuit breaker provided with an arc chamber, in which the melting phenomena of the arc-breaking metal plates in case of formation of an electrical arc in the arc chambers are avoided or at least greatly reduced.

Furthermore, the present invention is aimed at providing a low-voltage power circuit breaker provided with an arc chamber, in which the maintenance interventions for replacement of the arc-breaking metal plates in the arc chamber, or of the entire arc chamber, are unnecessary or greatly reduced.

Also, the present invention is aimed at providing a low-voltage power circuit breaker provided with an arc chamber, that is reliable and relatively easy to produce at competitive costs. Thus, the present invention relates to a low-voltage circuit breaker which comprises one or more electrical poles, each of said poles having an internal space with a contact area and an arc extinguishing area, a fixed contact assembly and a movable contact assembly being positioned in said contact area, said movable contact assembly being movable between a closed position in which it is into contact with said fixed contact assembly and an open position in which it is spaced apart from said fixed contact assembly, an arc chamber comprising a plurality of substantially parallel arc-breaking plates made of a ferromagnetic material being positioned in said arc extinguishing area. The low-voltage circuit breaker of the present invention is characterized in that said arc chamber further comprises at least one arc-breaking plate which is at least partially made of a ceramic material.

As better explained in the following description, thanks to the particular structure of the arc chamber of the low-voltage circuit breaker of the invention of the present invention, the above-mentioned problems can be avoided, or at least greatly reduced.

Indeed, the presence of one or more arc-breaking plates partially or totally made of a ceramic material in the arc chamber included in the presently disclosed circuit breaker allows avoiding, or at least greatly reducing, the damages on the arc chamber after short circuit conditions have developed into the chamber.

In other words, the particular set of the plates in the arc-breaking plates assembly of the circuit breaker of the present invention allows to better withstand the electrical and magnetic effects arising during the formation of an electrical arc in the arc chambers and at the same time to guarantee better insulation and reduce ablation of the solid surfaces with respect to the arc chambers of known type.

As better explained in the following description, in a typical embodiment of the circuit breaker of the present invention, said arc-breaking plate at least partially made of a ceramic material has a peripheral region which is made of a ferromagnetic material and a central region which is made of a ceramic material.

In this way it is possible to combine the positive effects of the metallic material and of the ceramic material in a synergic way.

In practice, the region which is more subjected to magnetic effects (i.e. peripheral region) is made of a metallic material and helps maintaining substantially the same performances of a full metal plate as far as the electrical and magnetic effects are concerned. At the same time, the central core made of ceramic material is far more resistant to the heat developed during arching phenomena, thereby avoiding—or at least considerably reducing—piercing or melting phenomena in the plate and the loss of insulation properties.

In any case, according to embodiments of the low-voltage circuit breaker of the present disclosure, it is possible that said arc chamber comprises at least one arc-breaking plate which is entirely made of a ceramic material, as well as any combination of arc-breaking plates totally or partially made of a ceramic material.

For the purposes of the present invention the use of the terms “metallic plates” and “ferromagnetic plates”, as well as “metallic material” and “ferromagnetic material” will be used interchangeably.

Also, for what concerns the ceramic materials, they are well known in the art and will not be described in details. Examples of ceramic materials suitable for use in the manufacturing of arc-breaking plates are the composite materials based on $Al_2O_3$ (pure corundum) and $SiO_2$ (silicon dioxide).

In a largely preferred embodiment of the low-voltage circuit breaker according to the present invention, said at least one arc-breaking plate which is at least partially made of a ceramic material is positioned in a zone of said arc extinguishing area proximate to said fixed contact assembly. In this way, the arc-breaking plates which are best suited to withstand the thermal, electric and magnetic effects, i.e. those containing both metallic material and ceramic material, are concentrated in the area where such effects are greater, i.e. close to the fixed contact assembly and the corresponding arc runner.

According to various embodiments of the low-voltage circuit breaker of the present invention, the number of arc-breaking plates at least partially made of a ceramic material used in the arc chamber can be chosen depending on a balance of cost/performance consideration. In general, even though a relatively high number of such plates could be used in the arc chamber, it is preferable to use a relatively limited number of arc-breaking plates at least partially made of a ceramic material and concentrate them in a zone of said arc extinguishing area proximate to said fixed contact assembly, for the reasons explained above.

As better shown in the following detailed description, in a typical embodiment of a low-voltage circuit breaker, according to the present invention, said at least one arc-breaking plate which is at least partially made of a ceramic material comprises a frame which is made of a ferromagnetic material and a core which is made of a ceramic material. The core of ceramic material is fitted inside said frame made of ferromagnetic material so as to match its internal profile, thereby obtaining an arc-breaking plate assembly in which the properties and performances of the ferromagnetic and ceramic materials are combined in a synergic manner, as previously explained. In such a case, in a particular embodiment of the presently disclosed low-voltage circuit breaker, the core made of a ceramic material can be conveniently provided with one or more tabs which engage corresponding recesses formed in the internal profile of said frame made of ferromagnetic material. The mechanical stability of the resulting plate assembly is in this way further improved. According to a further particular embodiment of the presently disclosed low-voltage circuit breaker, the at least one arc-breaking plate which is at least partially made of a ceramic material comprises a core made of a ceramic material which is fitted inside a first and a second adjacent frames made of a ferromagnetic material so as to match the internal profiles of said first and second adjacent frames made of a ferromagnetic material.

In practice in this embodiment, the core of ceramic material is thicker than frame of metallic material and is fitted inside two superimposed, adjacent, metallic frames. This solution allows avoiding the use of ceramic plates too thin and possibly brittle that may create some trouble their manufacturing and assembly processes.

In a typical embodiment of a low-voltage circuit breaker, said arc chamber comprises a plate assembly consisting of plurality of substantially parallel plates made of a ferromagnetic material and one or more arc-breaking plates at least partially made of a ceramic material; such assembly is conveniently inserted into an enclosure made of insulating material which in turn is positioned in the arc extinguishing area of each pole, according to well-known industrial embodiments.

Further features and advantages of the present invention will be more clear from the description of preferred but not exclusive embodiments of the low-voltage power circuit breaker of the present invention, shown by way of examples in the accompanying drawings, wherein.

Figure 1:
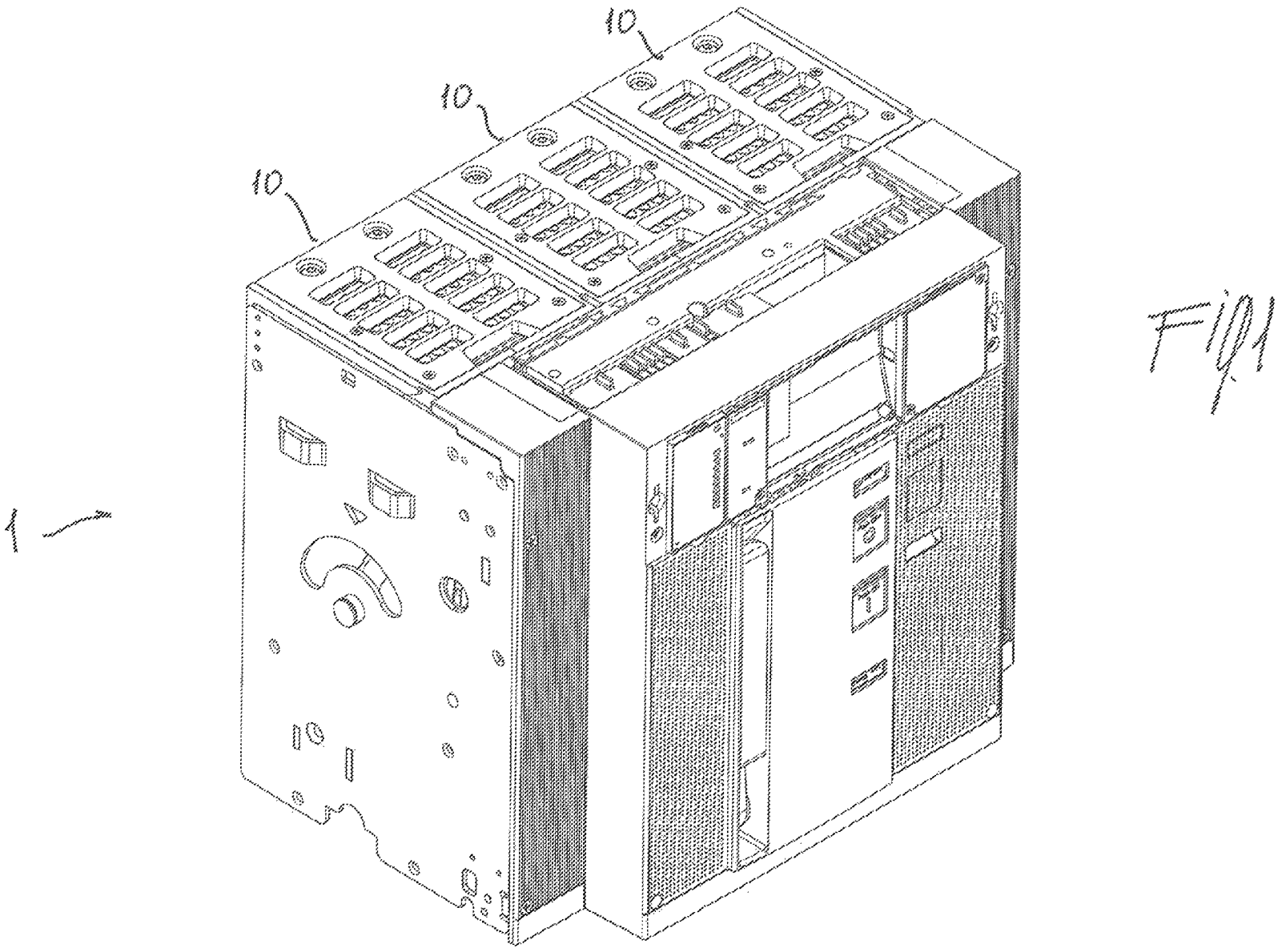
FIG. 1 is a perspective view of a low voltage power circuit breaker, according to the invention.

FIGS. 8*a*-8*e* are plan views of various embodiments of ceramic plates for an arc chamber in a pole of a low voltage power circuit breaker, according to the invention.

With reference to the attached figures, the low voltage power circuit breaker of the present invention, designated by the reference numeral 1, in its more general definition, comprises one or more electrical poles 10.

In the attached figure a pole of an air insulated switch is shown for exemplary purposes. However, the present invention is of more general applicability and can be used also in other kind of switches, such as molded case circuit breakers (MCCB) or low voltage switching device in which the arching phenomena need to be taken into account.

Figure 2:
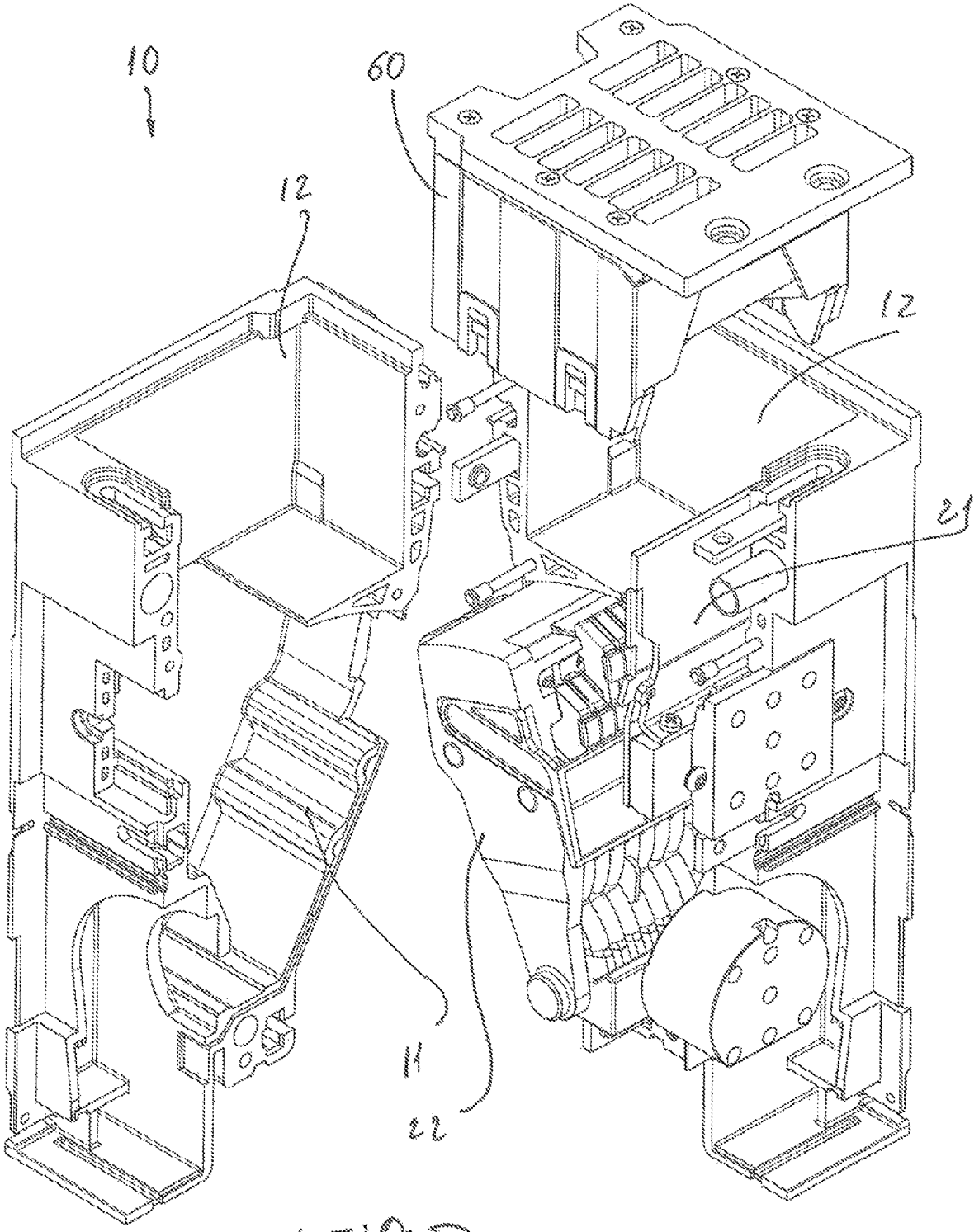
FIG. 2 is an exploded view of a pole of a low voltage power circuit breaker, according to the invention.
Figure 3:
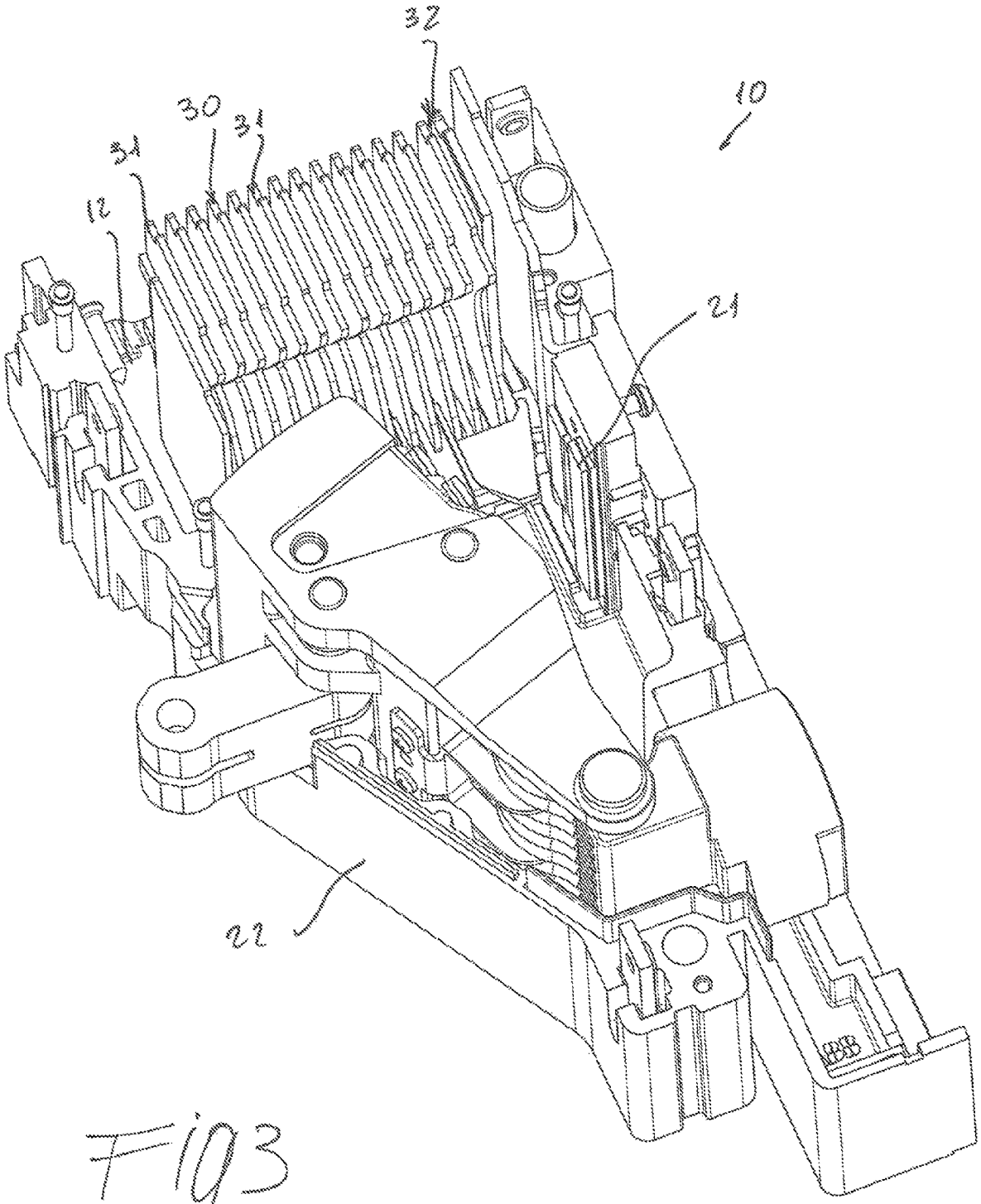
FIG. 3 is a first perspective view of a pole of a low voltage power circuit breaker, according to the invention.
Figure 4:
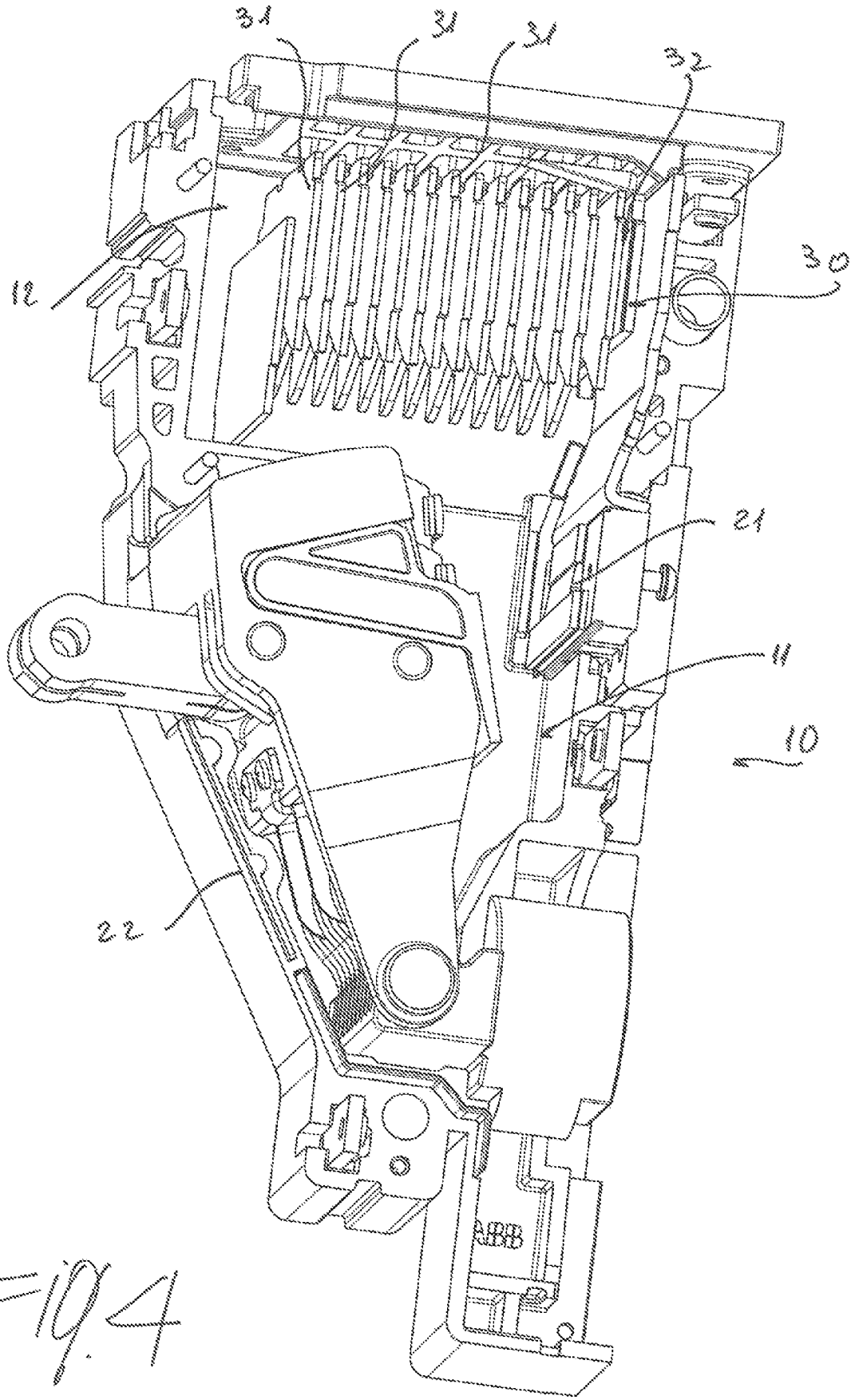
FIG. 4 is a second perspective view of a pole of a low voltage power circuit breaker, according to the invention.

With particular reference to FIGS. 2-4, a typical pole 10 of the circuit breaker 1 has an internal space delimited by an enclosure which, in the embodiment shown, is made of two half-enclosures coupled to each other.

Within said internal space of the pole 10, there is a contact area 11 and an arc extinguishing area 12, located proximate to said contact area 11. A fixed contact assembly 21 and a movable contact assembly 22 are respectively positioned in said contact area 11, said movable contact assembly 22 being movable between a closed position in which it is into contact with said fixed contact assembly 21 and an open position in which it is spaced apart from said fixed contact assembly 21. The set-up of a pole of circuit breaker of this kind is well known in the art and will not be described with further details.

Inside the internal space of the pole 10 there is also an arc chamber 30 positioned in said arc extinguishing area 12. According to embodiments well known in the art, the arc chamber 30 typically comprises a plurality of substantially parallel arc-breaking plates 31 made of a ferromagnetic material which are positioned in said arc extinguishing area 12.

One of the distinguishing features of the low-voltage circuit breaker of the present invention is given by the fact that said arc chamber 30 further comprises at least one arc-breaking plate 32 which is at least partially made of a ceramic material.

Indeed, the number of arc-breaking plates 32 comprising a ceramic material used in the arc chamber 30 can be selected according to the needs and cost/performance consideration, being possible to use in the arc chamber 30 only one (or a limited number) of such plates or a plurality of them.

Even if it is possible to use in the arc chamber 30 of the circuit breaker 1 of the present invention one or more arc-breaking plates which are entirely made of a ceramic material, it is largely preferred to use one or more arc-breaking plates which comprise portions made of a ceramic material and portions made of a ferromagnetic material.

In this respect, with reference also to FIG. 5-8, in largely preferred embodiments of the low-voltage circuit breaker 1 of the present invention, the arc-breaking plates 32, 33, 34, 35 at least partially made of a ceramic material have a peripheral region 330, 340, 350 which is made of a ferromagnetic material and a central region 335, 345, 355 which is made of a ceramic material. As previously explained the presence of both a metallic material and a ceramic material within the same plate allows combining in a synergic way the features and performances of the materials as far as magnetic, electrical, and thermal effects are concerned.

In still a further preferred embodiment of the low-voltage circuit breaker 1 of the present invention, the one or more arc-breaking plates 32, 33, 34, 35 at least partially made of a ceramic material are conveniently concentrated in a zone of said arc extinguishing area 12 which is proximate to said fixed contact assembly 21. Indeed the plates positioned in such zone are those subjected for more time to the arc effect and it is therefore preferable to have a relatively high number of arc-breaking plates 32, 33, 34, 35 comprising a ceramic material in a zone close to the fixed contact and the corresponding arc runner.

Figure 5:
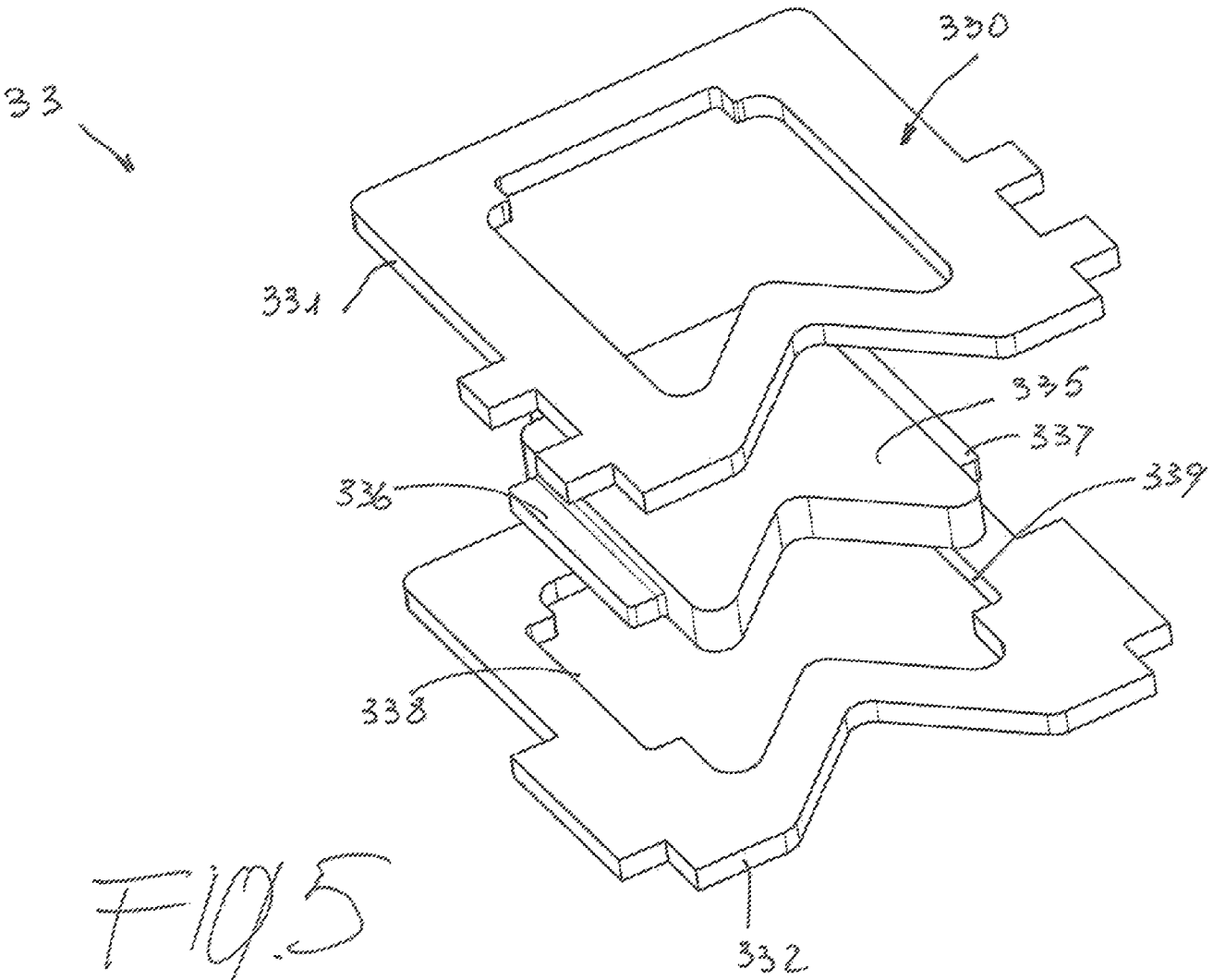
FIG. 5 is a perspective view of a first embodiment an arc-breaking plate for an arc chamber in a pole of a low voltage power circuit breaker, according to the invention.
Figure 6:
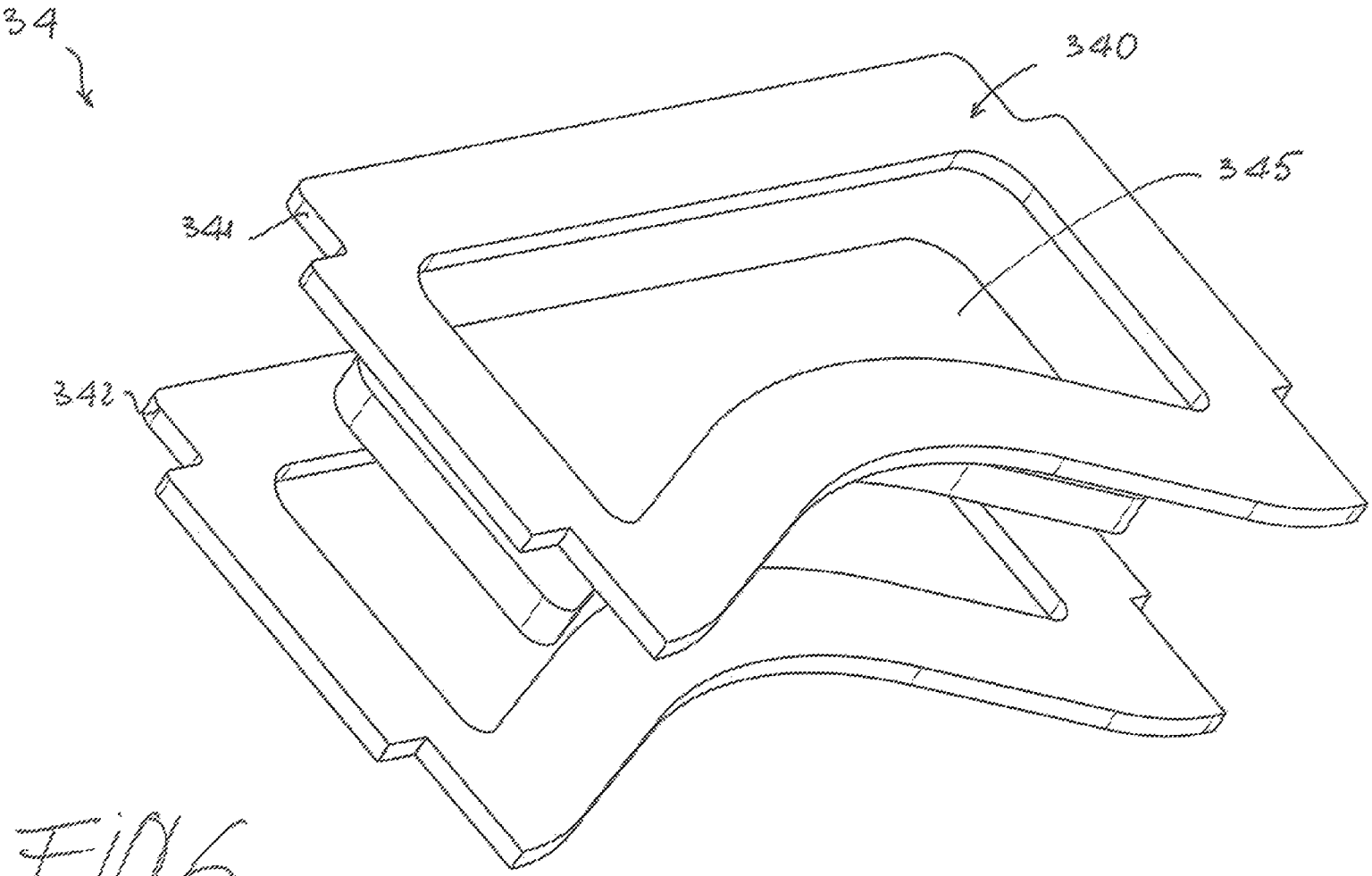
FIG. 6 is a perspective view of a second embodiment an arc-breaking plate for an arc chamber in a pole of a low voltage power circuit breaker, according to the invention.
Figure 7:
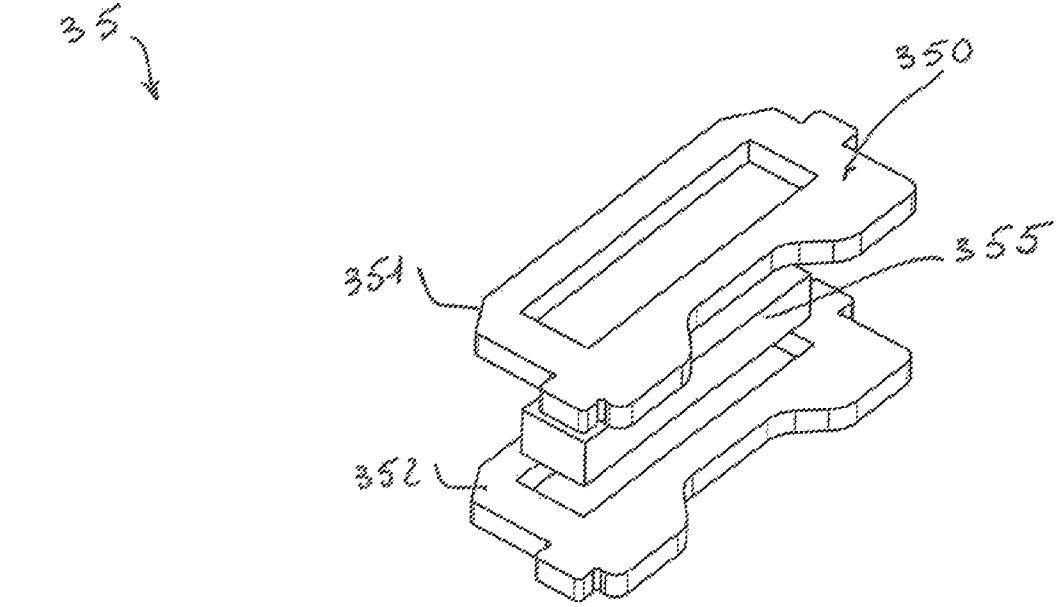
FIG. 7 is a perspective view of a third embodiment an arc-breaking plate for an arc chamber in a pole of a low voltage power circuit breaker, according to the invention.
Figure 8A:
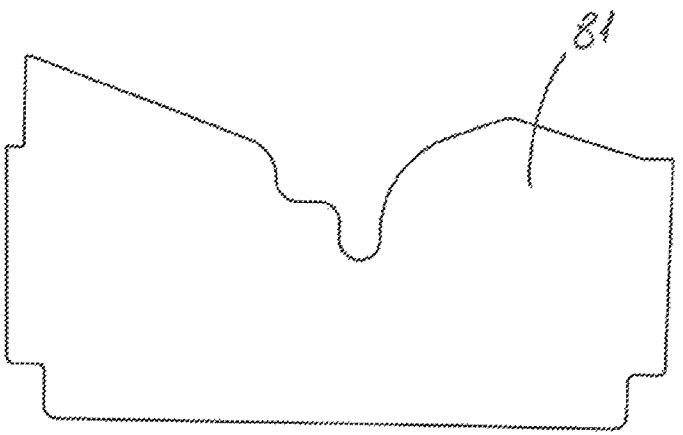
Figure 8B:
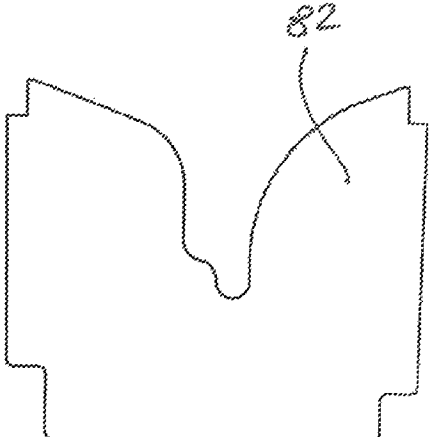
Figure 8C:
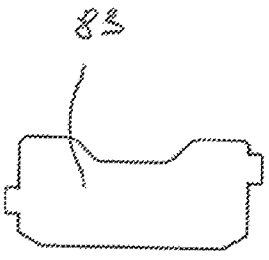
Figure 8D:
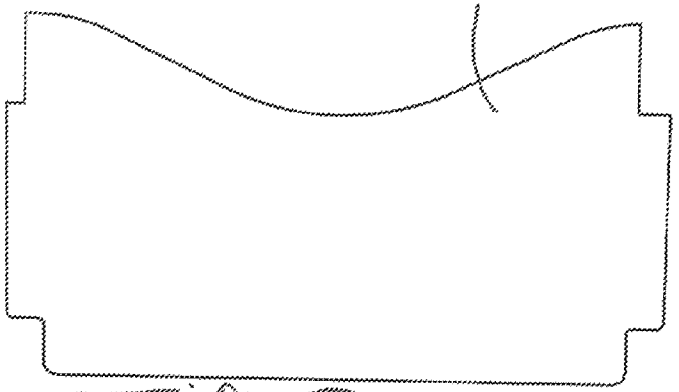
Figure 8E:
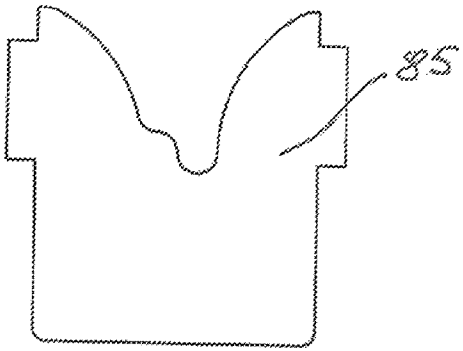

With reference to FIGS. 5-7, in typical embodiments of the present invention, the arc-breaking plates 33, 34, 35 which are at least partially made of a ceramic material comprise a frame 330, 340, 350 made of a ferromagnetic material and a core 335, 345, 355 made of a ceramic material. The core 335, 345, 355 of ceramic material is fitted inside said frame 330, 340, 350 of ferromagnetic material so as to match its internal profile, thereby obtaining a mechanically stable assembly.

The mechanical stability of the mixed plate assembly (i.e. frame made of a ferromagnetic material, core made of a ceramic material) can be further improved by providing, as shown in FIG. 5, the core 335 with one or more tabs 336, 337 engaging corresponding recesses 338, 339 formed in the internal profile of the frame 330 made of a ferromagnetic material.

As shown in the attached figures, the shape and dimensioning of the frames 330, 340, 350 as well as of the cores 335, 345, 355, 81, 82, 83, 84, 85 can be designed according to the needs.

In order to avoid troubles during manufacturing and assembly of the cores 335, 345, 355, 81, 82, 83, 84, 85, such cores preferably have a certain thickness which can be greater than the thickness of the corresponding frames 330, 340, 350.

In such a case, with reference to FIGS. 5 to 7, said at least one arc-breaking plate 33, 34, 35 which is at least partially made of a ceramic material comprises a core 335, 345, 355 made of a ceramic material which is fitted inside a first 331, 341, 351 and a second 332, 342, 352 adjacent frames made of a ferromagnetic material so as to match the internal profiles of said first 331, 341, 351 and second 332, 342, 352 adjacent frames made of a ferromagnetic material.

In other words, the core 335, 345, 355 of ceramic material is thicker than the frame of metallic material and is fitted inside two superimposed 331-332; 341-342; 351-352 adjacent, metallic frames. This solution allows avoiding the use of ceramic plates too thin and possibly brittle that may create some trouble their manufacturing and assembly processes and brings about a final assembly which is solid and mechanically stable.

In a typical embodiment of a low-voltage circuit breaker 1 of the present invention, said arc chamber 30 advantageously comprises a plurality of substantially parallel plates 31 which are made of a ferromagnetic material and one or more arc-breaking plate 32, 33, 34, 35 which are at least partially made of a ceramic material. The assembly of the metallic plates 31 and ceramic-containing plates 32, 33, 34, 35 is inserted into an enclosure 60 which is made of insulating material, said enclosure 60 being in turn positioned in the arc extinguishing area 12 of the pole 10 according to known industrial embodiment.

It is clear from the above description that the low voltage power circuit breaker of the present invention, fully achieve the intended aims and solved the above-highlighted problems of the existing electrical cabinets.

In practice, as previously explained, in the low voltage power circuit breaker of the present invention, the particular set of the plates in the arc-breaking plates assembly allows to better withstanding the electrical and magnetic effects arising during the formation of an electrical arc in the arc chambers and at the same time to guarantee better insulation and reduce ablation of the solid surfaces with respect to the arc chambers of known type.

In particular, it has been experimentally seen that by using an arc chamber with a combination of metallic and ceramic plates the electrical and magnetic effects of the conventional metallic plates were substantially maintained while the thermal performances were greatly improved with respect to the conventional arc chambers.

Several variations can be made to the low voltage power circuit breaker thus conceived, all falling within the scope of the attached claims. In practice, the materials used and the contingent dimensions and shapes can be any, according to requirements and to the state of the art.

The invention claimed is:

1. A low-voltage circuit breaker comprising one or more electrical poles, each of said poles having an internal space with a contact area, and an arc extinguishing area, a fixed contact assembly and a movable contact assembly being positioned in said contact area, said movable contact assembly being movable between a closed position in which it is into contact with said fixed contact assembly and an open position in which it is spaced apart from said fixed contact assembly, an arc chamber comprising a plurality of substantially parallel arc-breaking plates made entirely of a ferromagnetic material being position in said arc extinguishing area, said arc chamber further comprises at least one arc-breaking plate which is at least partially made of a ceramic material and is substantially parallel to the plurality of arc-breaking plates made of the ferromagnetic material, said arc chamber further comprising at least one arc-breaking plate which is entirely made of the ceramic material.

2. The low-voltage circuit breaker, according to claim 1, wherein said arc chamber comprises a plurality of arc-breaking plates which are at least partially made of a ceramic material.

3. The low-voltage circuit breaker, according to claim 1, wherein said arc-breaking plate at least partially made of a ceramic material has a peripheral region made of a ferromagnetic material and a central region made of a ceramic material.

4. The low-voltage circuit breaker, according to claim 1, wherein said at least one arc-breaking plate which is at least partially made of a ceramic material is positioned in a zone of said arc extinguishing area proximate to said fixed contact assembly.

5. The low-voltage circuit breaker, according to claim 1, further comprises a plurality of arc-breaking plates at least partially made of a ceramic material which are positioned in a zone of said arc extinguishing area proximate to said fixed contact assembly.

6. The low-voltage circuit breaker, according to claim 1, wherein said at least one arc-breaking plate which is at least partially made of a ceramic material comprises a frame made of a ferromagnetic material and a core made of a ceramic material, said core of ceramic material being fitted inside said frame of ferromagnetic material so as to match its internal profile.

7. The low-voltage circuit breaker, according to claim 6, wherein said core made of a ceramic material is provided with one or more tabs engaging corresponding recesses formed in the internal profile of said frame made of a ferromagnetic material.

8. The low-voltage circuit breaker, according to claim 6, wherein said at least one arc-breaking plate which is at least partially made of a ceramic material comprises a core made of a ceramic material which is fitted inside a first and a second adjacent frames made of a ferromagnetic material so as to match the internal profiles of said first and second adjacent frames made of a ferromagnetic material.

9. The low-voltage circuit breaker, according to claim 1, wherein said arc chamber comprises a plurality of substantially parallel plates made of a ferromagnetic material and at least one arc-breaking plate which is at least partially made of a ceramic material inserted into an enclosure made of insulating material positioned in said arc extinguishing area.

10. The low-voltage circuit breaker, according to claim 2, wherein said arc-breaking plate at least partially made of a ceramic material has a peripheral region made of a ferromagnetic material and a central region made of a ceramic material.

11. The low-voltage circuit breaker, according to claim 2, wherein said at least one arc-breaking plate which is at least partially made of a ceramic material is positioned in a zone of said arc extinguishing area proximate to said fixed contact assembly.

12. The low-voltage circuit breaker, according to claim 3, wherein said at least one arc-breaking plate which is at least partially made of a ceramic material is positioned in a zone of said arc extinguishing area proximate to said fixed contact assembly.

13. The low-voltage circuit breaker, according to claim 2, further comprises a plurality of arc-breaking plates at least partially made of a ceramic material which are positioned in a zone of said arc extinguishing area proximate to said fixed contact assembly.

14. The low-voltage circuit breaker, according to claim 3, further comprises a plurality of arc-breaking plates at least partially made of a ceramic material which are positioned in a zone of said arc extinguishing area proximate to said fixed contact assembly.

15. The low-voltage circuit breaker, according to claim 2, wherein said at least one arc-breaking plate which is at least partially made of a ceramic material comprises a frame made of a ferromagnetic material and a core made of a ceramic material, said core of ceramic material being fitted inside said frame of ferromagnetic material so as to match its internal profile.

16. The low-voltage circuit breaker, according to claim 15, wherein said core made of a ceramic material is provided with one or more tabs engaging corresponding recesses formed in the internal profile of said frame made of a ferromagnetic material.

17. The low-voltage circuit breaker, according to claim 7, wherein said at least one arc-breaking plate which is at least partially made of a ceramic material comprises a core made of a ceramic material which is fitted inside a first and a second adjacent frames made of a ferromagnetic material so as to match the internal profiles of said first and second adjacent frames made of a ferromagnetic material.

* * * * *